United States Patent [19]

Logsdon

[11] 3,967,642

[45] July 6, 1976

[54] AIR VOLUME REGULATOR FOR AIR CONDITIONING SYSTEMS

[75] Inventor: Hillard Glenn Logsdon, Charlotte, N.C.

[73] Assignee: Aeronca, Inc., Pineville, N.C.

[22] Filed: July 25, 1974

[21] Appl. No.: 491,696

[52] U.S. Cl. ..... 137/499; 98/110

[51] Int. Cl.[2] ..... F16K 31/12

[58] Field of Search ..... 137/499, 521, 511, 493.7; 98/110, 95; 251/25

[56] References Cited

UNITED STATES PATENTS

| | | | |
|---|---|---|---|
| 506,220 | 10/1893 | Furiakovics | 251/25 |
| 594,727 | 11/1897 | Cooper | 137/511 |
| 843,959 | 2/1907 | McBride | 137/499 |
| 1,635,040 | 7/1927 | Fales | 138/46 |
| 1,712,418 | 5/1929 | Boynton | 137/499 X |
| 2,116,912 | 5/1938 | Richardson | 137/499 X |
| 2,581,748 | 1/1952 | Blum | 137/499 |
| 2,749,833 | 6/1956 | Hekelaar | 137/499 X |
| 2,933,100 | 4/1960 | Waterfill | 137/499 |
| 3,276,480 | 10/1966 | Kennedy | 137/517 |
| 3,538,945 | 11/1970 | Dean, Jr. | 137/499 |
| 3,743,180 | 7/1973 | Perkins et al. | 236/1 C |
| 3,839,982 | 10/1974 | Martin | 137/493.7 X |

*Primary Examiner*—Martin P. Schwadron
*Assistant Examiner*—Robert J. Miller
*Attorney, Agent, or Firm*—Bell, Seltzer, Park & Gibson

[57] ABSTRACT

An air volume regulator for use in an air distribution duct for maintaining a substantially constant volume flow of air therethrough and having a pair of spaced apart opposing airfoils positioned so as to define a passageway for the flow of air therebetween, with the airfoils being pivotally mounted adjacent their leading ends with trailing portions extending in the downstream direction. The flow of air between the opposing airfoils exerts a force over the surface of the airfoils to pivotally move the same relative to each other so that the size of the air passageway between the airfoils is varied in response to fluctuations in upstream pressure to thereby maintain the flow of air from the regulator substantially constant.

18 Claims, 9 Drawing Figures

Fig-1
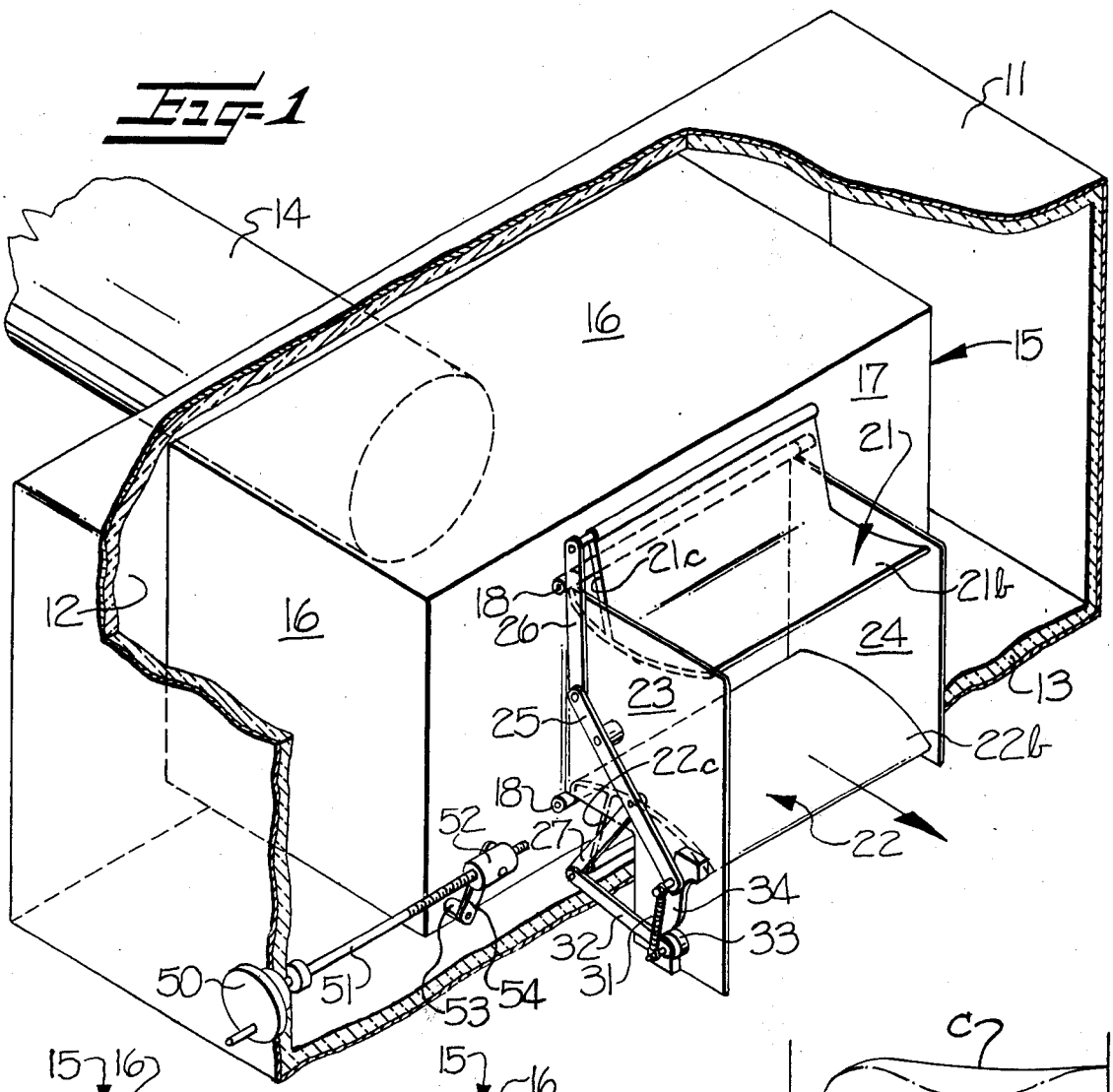
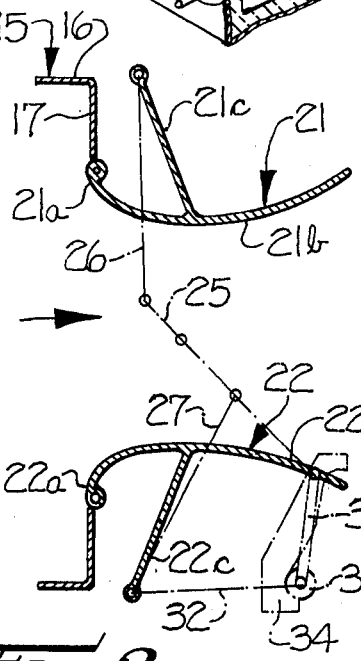
Fig-2
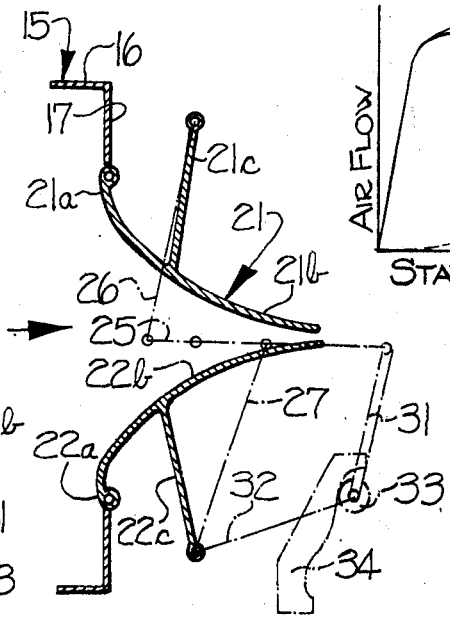
Fig-3
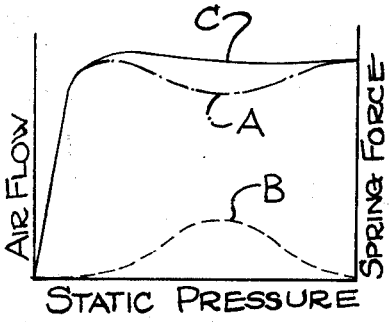
Fig-4

Fig-5
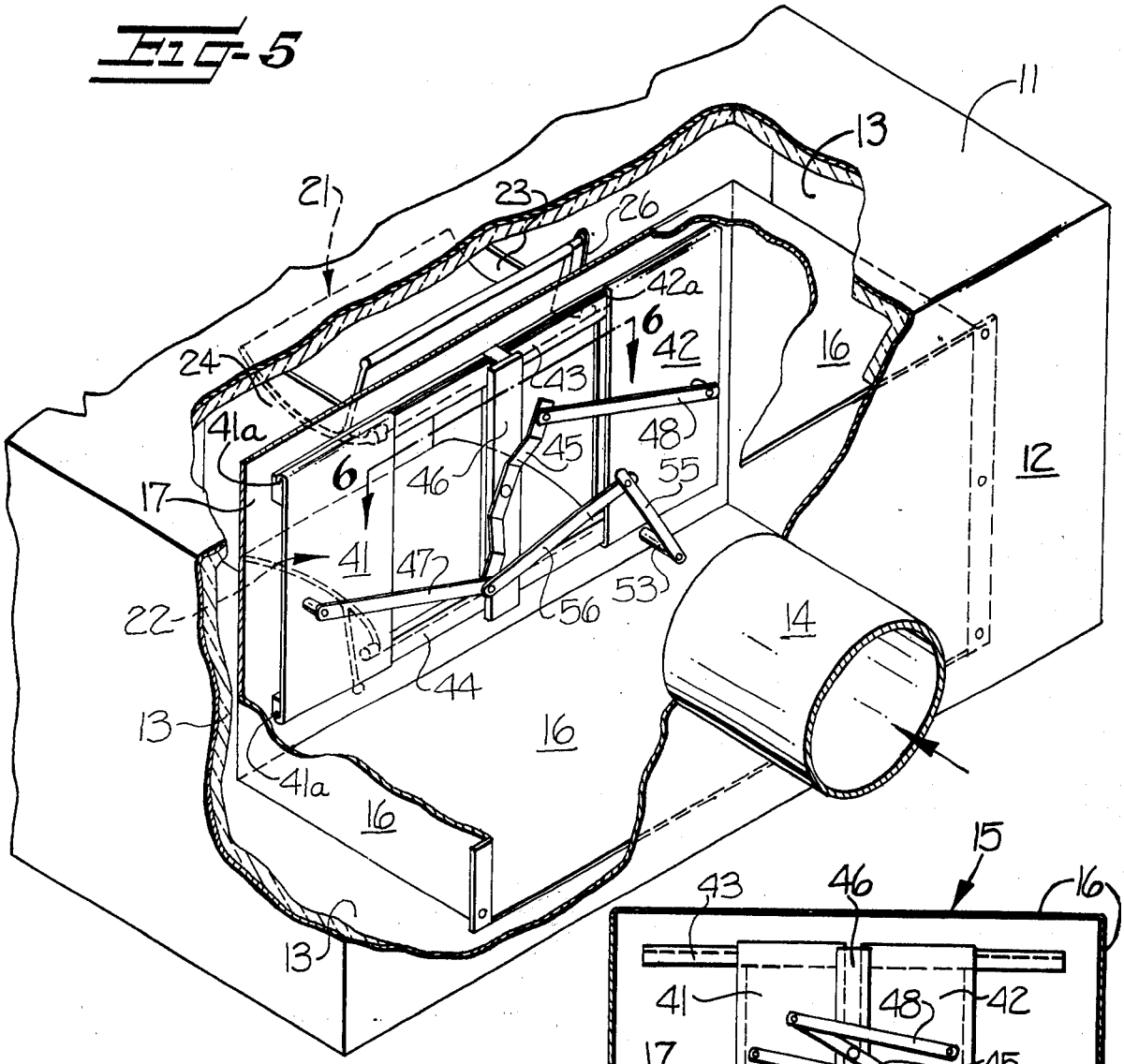
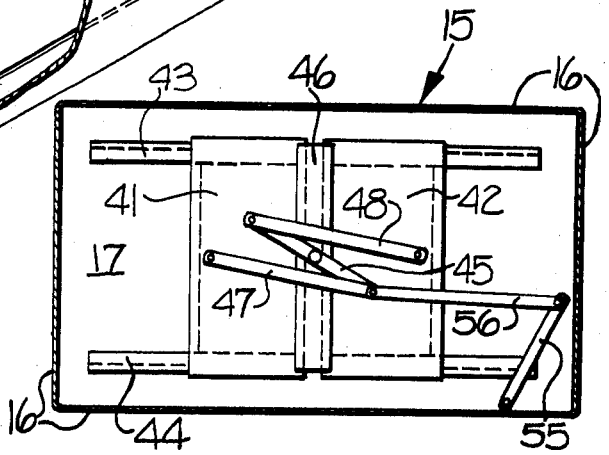
Fig-9
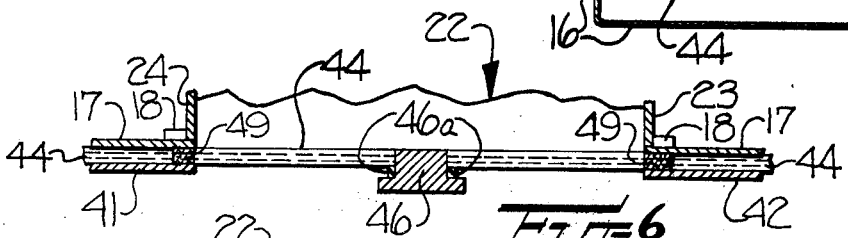
Fig-6
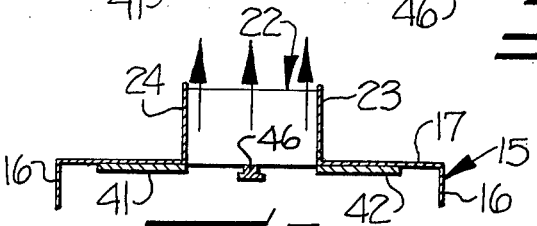
Fig-7
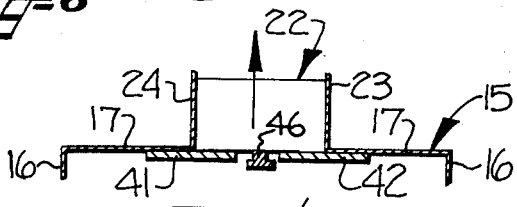
Fig-8

AIR VOLUME REGULATOR FOR AIR CONDITIONING SYSTEMS

This invention relates to air conditioning systems and more particularly to an air volume regulator adapted for maintaining a substantially constant volume flow of air therethrough.

In air conditioning systems where air is supplied from a central conditioning device to a plurality of individual distributing units or terminals, changing demands for air in the rooms or zones being conditioned will cause pressure variations in the air supply lines or ducts with resultant variations in the volume of air flowing therethrough. Accordingly, the individual air distributing units are conventionally provided with air volume regulators adapted for maintaining a substantially constant volume flow of air therethrough regardless of variations in pressure in the air supply lines leading thereto.

The present invention has as its general object to provide an improved air volume regulator adapted for maintaining the air delivered therefrom at a substantially constant volumetric flow rate regardless of fluctuations in the pressure of the air being supplied to the regulator.

More particularly, it is an object of this invention to provide an improved air volume regulator which maintains a substantially constant volume flow of air therethrough by employing movable airfoil means for controlling the flow of air.

It is a further object of this invention to provide a constant volume regulator of a simplified construction which may be manufactured at a reduced cost as compared to existing conventional volume regulators.

It is another object of this invention to provide an air volume regulator of the type described, wherein the regulator is adjustable for accurately maintaining a constant volume flow of air over a wide range of different flow rates or settings.

In accordance with this invention, a substantially constant volume flow of air is maintained through the regulator by the employment of airfoil means in the form of opposing airfoils which are positioned in spaced apart relation so as to define a passageway for the flow of air therebetween and which are pivotally mounted adjacent their leading edges with trailing portions extending in the downstream direction. The flow of air between the opposing airfoils exerts a force over the surface of the airfoils to move the same relative to each other so that the size of the air passageway between the opposing airfoils is varied in response to fluctuations in upstream pressure to thereby maintain the flow of air from the regulator substantially constant.

In the regulator construction of this invention, the quantity of air permitted to pass between the airfoils is a function of the spacing between the pivotal axes of the airfoils and the area of the airfoil surface exposed to the air flow. In order to permit adjusting the regulator for maintaining a different substantially constant flow rate, the regulator may be provided with means located upstream of the airfoils and in the path of air flow thereto for varying the effective area of the airfoil surface exposed to the air flow. In the form of the invention illustrated, adjustment of the volume setting of the air volume regulator is accomplished by adjustable gate means shown in the form of a pair of opposing gates positioned adjacent the leading edges of the airfoils and mounted for sliding movement toward or away from one another to vary the amount of the airfoil surface exposed to the air flow.

In order to facilitate obtaining a more uniform and accurate control of air by the regulator, means may be employed in association with the airfoils for exerting a bias on the airfoils which is operable over at least certain positions of the airfoils relative to one another and which varies in accordance with the positions of the airfoils relative to one another. This arrangement serves to provide an essentially flat or linear control response over a wide range of upstream pressures.

Some of the objects and advantages of the invention having been stated, others will appear as the description proceeds when taken in connection with the accompanying drawings, in which FIG. 1 is an isometric view, with parts broken away, of a portion of an air distribution unit employing an air volume regulator in accordance with this invention;

FIGS. 2 and 3 are schematic sectional views of the air volume regulator showing the positions assumed by the opposing pivotally mounted airfoils under various conditions of upstream pressure, and showing in phantom lines the linkage interconnecting the opposing airfoils and the spring and compensating cam arrangement associated therewith;

FIG. 4 is a graph illustrating the air flow obtained from the regulator as a function of the static pressure of the air supplied to the regulator, and also illustrating the variable bias exerted by the spring and compensating cam arrangement as function of static pressure;

FIG. 5 is an isometric view, with parts broken away, of the air distribution unit illustrated in FIG. 1, as viewed from the opposite end thereof looking in the downstream direction, and showing the adjustable volume control gates associated with the volume regulator;

FIG. 6 is a sectional view showing the volume control gates taken substantially along line 6—6 of FIG. 5;

FIG. 7 and 8 are simplified schematic views similar to FIG. 6 and showing the adjustable volume control gates at various positions; and FIG. 9 is an elevational view showing the volume control gates in closed position.

Referring now more particularly to the drawings, FIG. 1 illustrates an air distribution unit or terminal adapted for being installed in a central air conditioning system for controlling the flow of conditioned air into an air-conditioned room or zone. The air distribution unit includes a hollow generally rectangular housing 11 having opposing pairs of side walls and an end wall 12 at the upstream end thereof. As is conventional, the inner surfaces of the walls of housing 11 may be covered with suitable thermal and sound insulating material 13. An air distribution or supply duct 14 supplying conditioned air under relatively high pressure from a central conditioning device communicates with housing 11 through an opening in end wall 12 thereof.

Positioned within housing 11 in communication with air distribution duct 14 and carried by upstream end wall 12 of housing 11 is an inner conduit or duct, generally indicated at 15 which is cantilever mounted from housing 11. As illustrated, conduit 15 has a downstream end wall 17 which is cantilever supported by pairs of opposing parallel, generally rectangular side walls 16 which in turn are mounted on end wall 12 and extend within housing 11 in spaced apart relation from the side walls thereof. End wall 17 has a generally rectangular opening therein for the flow of air therethrough and additionally serves as a supporting wall for component parts of the volume regulator, which are mounted on opposite sides of the wall 17 adjacent the opening therein.

Conduit 15 serves as an expansion chamber for the relatively high pressure air being delivered from supply duct 14 and also serves for absorbing and dampening vibrations created by the air flowing through the regulator to avoid transmitting the vibrations to the walls of housing 11. This type of cantilever mounting for volume regulators is the subject of my commonly assigned copending application Ser. No. 438,573, filed Feb. 1, 1974, now U.S. Pat. No. 3,911,958 and entitled LOW NOISE LEVEL AIR FLOW CONTROL UNIT, to which reference may be made for further details thereof. The cantilever mounting arrangement illustrates a preferred environmental setting for the volume regulator of this invention, but it will be appreciated that the regulator may also be mounted by other means in air conditioning systems using various other types of ducts or housings conveying air under either relatively high or low pressure.

Referring now more particularly to the construction of the volume regulator it will be seen from FIG. 1 that the regulator includes a pair of airfoils, generally indicated at 21 and 22, which are carried by and mounted adjacent to the opening in supporting wall 17 and in opposing relation to one another for receiving therebetween the flow of air from the opening. More particularly, it will be seen that the opposing airfoils 21, 22 have their leading edges 21*a*, 22*a* extending generally parallel to one another along opposite sides of the opening in wall 17 with trailing portions 21*b*, 22*b* of the airfoils extending in opposing relation in the downstream direction. The airfoils are mounted for pivotal movement adjacent their leading edges 21*a*, 22*a* by any suitable means, such as the hinge means 18 which are carried by wall 17 of conduit 15. Thus, it will be seen that opposing trailing portions of the airfoils may move relative to one another and form a variable size constriction in the flow passageway downstream of the opening in wall 17.

The opposing facial surfaces of the airfoils 21 and 22 have shapes such that the air flowing thereacross will exert a force on the respective opposing airfoils to pivotally move the same relative to one another. While the particular configuration of the airfoil surfaces may take various forms, in the embodiment of the invention illustrated, the airfoils are in the form of curved blades of a generally cylindrical nature having similar generally convex curved facial surfaces along the direction of air flow and having a uniform cross section and surface configuration in the direction transverse to the direction of air flow. The airfoils may be economically formed by conventional extrusion methods from any suitable material, as for example aluminum alloy.

In operation, the freely movable opposing airfoils tend to "float" in the stream of air passing thereover and, in accordance with aerodynamic principles, move relative to one another in response to fluctuations in upstream pressure, varying the size of the air passageway therebetween and thereby maintaining the flow of air through the regulator substantially constant. Simply stated, the higher the air velocity over the airfoil surfaces, the greater the "lift" created by the air movement. Therefore, as the air velocity increases through the regulator due to an increase in total pressure upstream of the regulator, the airfoils are drawn together, restricting the air passageway therebetween so that a constant volumetric flow rate of air is maintained. When the air velocity across the airfoil surfaces decreases, as would occur for example upon a demand for an increased flow of air elsewhere along the air supply duct, the decreased "lift" resulting therefrom permits the opposing airfoils to be pushed further apart so that the size of the air passageway is increased and the flow of air from the regulator is maintained at a substantially constant rate. It will thus be appreciated that the airfoils operate to maintain constant air flow without the need for an external power source as is required in some types of known air volume regulators, and without the necessity of employing a spring or other biasing means as is employed in the operation of most conventional self-contained or non-powered air volume regulators.

The operation of the airfoils under varying upstream conditions may be more readily understood by referring to the schematic illustrations of FIGS. 2 and 3. As illustrated in FIG. 2, the total pressure upstream of the regulator is relatively low and the opposing airfoils have assumed a relatively widely spaced apart position. The portion of the airfoil surface over which the lifting force is generated is between the leading edges 21*a*, 22*a* of the airfoils and the point of tangency of the direction of air flow with the curved airfoil surface. Upon an increase in pressure upstream and a resulting increase in velocity over the airfoils, the airfoils move to a more closely spaced position, such as is illustrated in FIG. 3. In this position, the effective area of the airfoil surface over which the lifting force is exerted is greater and the point of greatest constriction between opposing trailing portions of the airfoils is positioned further downstream from the leading edges of the airfoils.

The curved cylindrical shape of the airfoil surfaces in accordance with the illustrated preferred form of the invention effectively maintains substantially uniform flow control over a wide range of upstream pressures and advantageously avoids appreciable fluttering of the airfoils during operation. Referring more particularly to the shape of the airfoils, it will be noted that the convex curvature in each of the airfoils has a plurality of different radii, with the radius of curvature being smallest adjacent the leading edge of the airfoil and increasing in the downstream direction. At any pivotal position assumed by the opposing airfoils, this curvature may be viewed as defining an ASME nozzle configuration in two dimensions between the leading edges of the opposing airfoils and the point of tangency of the airstream on the trailing portions of the airfoils.

As illustrated, the regulator may also include a pair of opposing fixed parallel walls 23 and 24 positioned closely adjacent lateral edges of trailing portions of the opposing airfoils 21 and 22 cooperating with the airfoils so that the restricted passageway downstream of the opening in the supporting wall is enclosed on all sides.

To facilitate operation of the volume regulator, linkage means may be provided interconnecting the opposing airfoils so that the airfoils move in unison toward or away from each other. By having the airfoils interconnected in this manner, the volume regulator will provide effective flow control regardless of the attitude in which it is installed. For example, when installed in the horizontal attitude illustrated, the airfoils are essentially balanced, since the weight of the upper airfoil 21 tending to fall toward a more closed position is effectively counterbalanced by the weight of the lower airfoil 22 tending to fall to a more open position. Similarly when the regulator is positioned in an inclined or vertical attitude, the airfoils are also in a balanced freely movable condition. Referring more particularly to the linkage means, it will be seen that each airfoil has integrally formed therewith a leg 21*c*, 22*c* extending rearwardly away from the curved surface of the airfoil member and serving to facilitate interconnecting the opposing airfoils. A central link 25 is pivotally connected to wall 23 adjacent one side of the opposing airfoils and respective link arms 26 and 27 serve to interconnect the legs 21*c*, 22*c* of the airfoils with the central link 25 so that the opposing airfoils operate in unison in opposition to one another.

In accordance with one aspect of this invention, it has been found that the constant volume flow characteristics of the volume regulator of this invention may be more accurately maintained, to very close tolerance if desired, by employing means in association with the airfoils for exerting a bias on the airfoils which varies in accordance with the positions of the airfoils relative to one another. The variable biasing means is best understood by referring to the graph of FIG. 4. Curve A represents the flow rate characteristics of the volume regulator as a function of upstream air pressure where no compensating or biasing means is employed. It will be seen that as the static pressure in the duct upstream of the regulator increases, the airflow rises rapidly up to the control point of the regulator. As static pressure is further increased, the flow rate falls off slightly over intermediate ranges of static pressure and then increases slightly toward the maximum static pressure generally encountered with the regulator. This slight non-linearity in control response is acceptable in most installations. However, under some circumstances, it is desired to more accurately control the air flow rate to a closer tolerance. This may be accomplished by exerting a variable bias on the pair of airfoils when the airfoils are in certain positions relative to one another so as to "flatten out" the control response of the regulator.

In the embodiment of the invention illustrated, this has been accomplished by spring and compensating cam arrangement which exerts a relatively small opening bias on the pair of airfoils which varies in accordance with the position of the airfoils relative to one another. This small variable opening bias is effective over intermediate positions of the airfoils relative to one another and serves to alter slightly the position ordinarily assumed by the airfoils over intermediate ranges of static pressure so as to upwardly adjust the flow rate permitted over these ranges of static pressures. Referring again to the graph of FIG. 4, curve B represents the variable opening bias exerted on the airfoils as a function of static pressure, with the opening bias having a maximum at intermediate values of static pressure and having a minimum value at the maximum and minimum ranges of static pressure encountered in the regulator. From earlier discussions, it will be understood that the position assumed by the opposing airfoils during operation is also a function of static pressure. Curve C represents the air flow characteristics of the air volume regulator when the variable bias is applied to the airfoils, and it will be seen that the flow rate maintained by the regulator is essentially flat or constant once the static pressure increases to the operating range of the regulator.

Referring again to FIG. 1, the variable opening bias is accomplished by spring and compensating cam arrangement which operates in association with the linkage interconnecting the opposing airfoils. A lightweight coil spring 31 has one end thereof connected to an extended end portion of central link 25. The opposite end of spring 31 is connected to one end of a link arm 32 and to a cam follower 33. The opposite end of link arm 32 is pivotally connected to the integral leg 22*e* of airfoil 22. A cam 34 is mounted on a lower extending portion of wall 23, with the configured cam surface thereof cooperating with cam follower 33 in such a manner that as the airfoils move toward or away from each other, both ends of the spring are moved relative to each other so as to produce a bias which varies dependent upon the position of the airfoils relative to one another.

As noted earlier, the volumetric flow rate which the regulator maintains is a function of both the distance between the pivotal axes of the airfoils and also the area of the airfoil surface exposed to the airstream. When it is desired to provide the capability of varying the control setting of the volume regulator of this invention, this may be easily accomplished by providing means upstream of the airfoils and in the path of air flow thereto for varying the amount or area of the airfoil surface exposed to the air flow. As illustrated in FIG. 5, a pair of opposing gates 41 and 42 are mounted on the upstream side of supporting wall 17 for sliding movement along a direction parallel to the leading edges of the airfoils so as to thereby vary the effective lateral extent of the airfoil surface exposed to the air flow. The spacing or distance between the slidably mounted gates 41 and 42 may be varied as desired from a fully opened position as illustrated in FIGS. 5, 6 and 7 wherein the entire lateral extent of the airfoils are exposed to the air flow and maximum air flow is obtained; through intermediate positions such as represented in FIG. 8 wherein only a portion of the airfoil surfaces are exposed to the air flow and an intermediate volumetric flow rate is maintained; or to fully closed position wherein the flow of air from the regulator is stopped. When gates 41 and 42 are in intermediate positions between fully opened and fully closed, only a portion of the surface of the airfoils is exposed to air flow. In the intermediate positions such as is illustrated in FIG. 8, for example, the airstream passes primarily over only the medial portions of the airfoils. While the airstream flares out somewhat after passing through gates 41 and 42, walls 23 and 24 do not serve any substantial purpose for restricting or guiding to air flow in such intermediate gate positions.

Gates 41 and 42 are provided with suitably turned lips 41*a*, 42*a* at the upper and lower ends thereof adapted for riding in corresponding grooves in upper and lower trackways 43 and 44 carried by supporting wall 17. The sliding gates 41 and 42 are interconnected for movement in unison toward or away from one another by suitable linkage means including a central pivotally mounted link 45 supported by a medial vertically extending strut 46, with link arms 47 and 48 interconnecting the gates 41 and 42 with the central link 45.

Suitable resilient sealing means, such as felt strips 49 (FIG. 6) may also be provided between the supporting wall 17 and gates 41 and 42 for preventing unwanted flow of air therebetween. Similarly, resilient seals or gaskets 46a may be provided in the T-shaped central strut 46 to permit effecting a tight seal when gates 41 and 42 are in fully closed position so that the flow of air from the regulator may be fully stopped, when desired.

To facilitate adjusting the position of the gates from externally of the housing 11, suitable linkage may be provided in association with the gates and extending through the wall of the housing 11. As illustrated in its simplest form, a hand wheel adjustment knob 50 is mounted at an accessible location on the exterior of housing 11 with a shaft 51 extending therefrom into the interior of the housing. The inner end portion of shaft 51 is threaded and has positioned thereon a cooperating threaded slide member 52. A rotatable stub shaft 53 extends through supporting wall 17 and has positioned on the downstream end thereof a crank arm 54 which is pivotally connected to sliding member 52. A crank arm 55 on the upstream end of stub shaft 53 and a connecting arm 56 associated therewith serve for interconnecting the central pivotal link 45 to the rotatable stub shaft 53 so that rotation of the stub shaft upon turning of knob 50 will position the movable gates 41 and 42 to select any desired constant volume output from the regulator.

The adjustable air volume regulator having manual adjustment means of the type just described may be suitably employed in air conditioning systems such as constant volume systems where it is desired to have a controlled constant flow of air, but where it is sometimes necessary to manually adjust the control setting of the regulator. The adjustable air volume regulator of this invention may also be employed in variable volume air conditioning systems where the controlled flow of air is varied in response to changing demands in the room or zone being conditioned. In such variable volume applications, a suitable control actuator such as a pneumatic or electric motor operating under the control of a suitable control such as a thermostat may be employed for repositioning the volume control gates as required.

Since the volume control gates 41 and 42 move perpendicular to the air flow rather than in opposition thereto, they may be adjusted with a relatively small amount of force regardless of the amount of upstream pressure exerted thereon. The gates are quiet in operation and may be adjusted by a relatively inexpensive and low powered control actuator having a relatively short stroke. Further, it will be seen that since there is no mechanical interconnection between the airfoils and the adjustable gates, the constant volume air flow control feature is not affected by the changing of the gate position. Thus, the regulator is always in control of the air flow at any setting of the volume control gates within the range of the regulator.

In the drawings and specification there has been set forth a preferred embodiment of the invention and although specific terms are employed, they are used in a generic and descriptive sense only and not for purposes of limitation.

That which is claimed is:

1. An air distribution unit for use in air conditioning systems for controlling the flow of conditioned air into an air-conditioned room or zone and comprising a regulator housing adapted for receiving therethrough a flow of conditioned air supplied to the housing, and an air volume regulator mounted in said housing and operable for maintaining the flow of air through the housing at a substantially constant volumetric flow rate regardless of fluctuations in the supply pressure thereof, said regulator comprising a pair of airfoils positioned in said housing in spaced apart relation to one another so as to receive therebetween the flow of air passing through the housing, said airfoils having generally parallel spaced apart leading edges and having facial surfaces extending downstream from the leading edges of the airfoils and exposed to the flow of air thereacross, means mounting said airfoils along the leading edges thereof for pivotal movement in said housing and in inwardly spaced relation from the walls of the housing, and linkage means interconnecting said pivotally mounted airfoils for effecting unison movement of the airfoils toward or away from each other, the flow of air across the facial surfaces of the airfoils exerting a force thereon to pivotally move the airfoils toward or away from each other in response to fluctuations in upstream pressure to vary the spacing between the airfoils through which the air flows and thereby maintain the flow of air from the regulator substantially constant.

2. An air distribution unit according to claim 1 including means located upstream of said pair of airfoils in the path of air flow thereto for varying the amount of the airfoil surface exposed to the air flow to thereby vary the volume setting of the regulator.

3. An air distribution unit according to claim 1 including means operably connected to said pair of airfoils and operable over at least certain intermediate positions of the airfoils relative to one another for exerting a bias on the airfoils variable in accordance with the respective intermediate positions of the airfoils relative to one another to thereby facilitate obtaining more uniform control of air flowing through the regulator.

4. An air distribution unit according to claim 1 including a cantilever mounted conduit located within said regulator housing and positioned on the upstream side of said opposing airfoils and having an opening in the downstream end thereof for the flow of air therethrough, and said means mounting said airfoils for pivotal movement in said housing positioning the airfoils on said conduit adjacent said opening for receiving therebetween the flow of air through the opening.

5. An air distribution unit according to claim 1 including a pair of opposing walls extending in a downstream direction and positioned closely adjacent the respective sides of the pair of airfoils and cooperating with the airfoils to define an enclosed constricted passageway.

6. An air distribution unit for use in air conditioning systems for controlling the flow of conditioned air into an air-conditioned room or zone and comprising a regulator housing adapted for receiving therethrough a flow of conditioned air supplied to the housing, and an air volume regulator mounted in said housing and operable for maintaining the flow of air through the housing at a substantially constant volumetric flow rate regardless of fluctuations in the supply pressure thereof, said regulator comprising a pair of airfoils positioned in said housing in spaced apart opposing relation to one another so as to receive therebetween the flow of air passing through the housing, said airfoils having generally parallel spaced apart leading edges extending substantially perpendicular to the direction of air flow and having opposing curved facial surfaces extending downstream from the leading edges of the airfoils and exposed to the flow of air thereacross, means mounting said airfoils along the leading edges thereof for pivotal movement in said housing and in inwardly spaced relation from the walls of the housing, and linkage means interconnecting said pivotally mounted airfoils for effecting unison movement of the airfoils toward or away from each other, the flow of air across the curved facial surfaces of the opposing airfoils exerting a force thereon to pivotally move the airfoils toward or away from each other in response to fluctuations in upstream pressure to vary the spacing between the airfoils through which the air flows and thereby maintain the flow of air from the regulator substantially constant.

7. An air volume regulator for maintaining a substantially constant volume flow of air regardless of fluctuations in upstream pressure, said regulator including a pair of opposing airfoils in the form of curved blades adapted to be positioned in a path of air flow so as to receive the flow of air therebetween, said opposing airfoils having generally parallel spaced apart leading edges extending substantially perpendicular to the direction of air flow and having opposing curved facial surfaces extending downstream from the leading edges in the direction of air flow, and means adjacent the leading edge of each airfoil mounting the same for pivotal movement about an axis extending parallel to the leading edge thereof, the flow of air between the opposing curved surfaces of the airfoils exerting a force over the surface of the airfoils to pivotally move the same toward or away from each other in response to fluctuations in upstream pressure to vary the size of the air passageway between the airfoils and thereby maintain the flow of air from the regulator substantially constant.

8. An air volume regulator according to claim 7 wherein the curvature of each of said airfoils has a plurality of different radii, with the radius of curvature being smallest adjacent the leading edge of the airfoil and increasing along the direction of air flow.

9. An air volume regulator according to claim 7 wherein said airfoils comprise a pair of extruded members of uniform cross section, and the opposing curved surfaces of the airfoils comprise cylindrical facial surfaces defined by imaginary lines moving parallel to the respective pivotal axes of the airfoils.

10. An air volume regulator according to claim 9 wherein each of said pair of extruded airfoil members has a leg formed integrally therewith and extending rearwardly away from the back of the airfoil, and wherein linkage means is provided interconnecting the respective legs on said airfoil members so that the opposing airfoils move in unison toward or away from each other.

11. An air volume regulator according to claim 7 including adjustable gate means upstream of the pair of airfoils and adjacent the leading edges thereof, said gate means being mounted for movement in a direction substantially parallel to the leading edges of the airfoils to vary the amount of the airfoil surface exposed to the air flow and thereby serving to vary the volume setting of the regulator.

12. An air volume regulator according to claim 11 wherein said adjustable gate means comprises a pair of opposing gates, and means cooperating with said gates for moving the same relative to one another to thereby permit adjusting the volume setting of the regulator.

13. An air volume regulator according to claim 7 including a cantilever mounted conduit positioned on the upstream side of said opposing airfoils and having an opening in the downstream end thereof for the flow of air therethrough, and means pivotally mounting said opposing airfoils on said conduit adjacent said opening for receiving therebetween the flow of air through the opening.

14. An air volume regulator for maintaining a substantially constant volume flow of air regardless of fluctuations in upstream pressure, said regulator comprising means mounted in the path of air flow and having an opening therein for the flow of air therethrough, a pair of airfoils mounted for pivotal movement adjacent said opening in opposing relation to one another for receiving therebetween the flow of air from the opening, said airfoils having leading edges positioned in spaced apart generally parallel relation with trailing portions extending in the downstream direction, said airfoils having opposing facial surfaces of similar generally convex curvature along the direction of air flow and each being of substantially uniform cross section transverse thereto, said opposing airfoils defining a flared mouth adjacent said opening and a variable size constriction for the flow of air between opposing trailing portions of the airfoils, the flow of air between the opposing airfoils exerting a force over the surface of the airfoils to move the same relative to each other in response to fluctuations in upstream pressure to vary the size of the air passageway between the airfoils and thereby maintain the flow of air from the regulator substantially constant.

15. An air volume regulator according to claim 14 including a pair of opposing walls extending in a downstream direction and positioned closely adjacent the respective sides of the pair of airfoils and cooperating with the airfoils to define an enclosed constricted passageway.

16. An air volume regulator according to claim 15 including adjustable gate means positioned adjacent to and upstream of said opening and movable in a direction substantially parallel to the leading edges of the airfoils for varying the amount of the airfoil surface exposed to the air flow and thereby permitting varying the volume setting of the regulator.

17. An air volume regulator according to claim 14 including linkage means operatively interconnecting said pair of opposing airfoils for effecting unison movement of the airfoils toward or away from each other, spring means cooperating with said linkage means for biasing the opposing airfoils toward an open position and means associated with said spring means for varying the biasing force exerted by said spring means in accordance with the position of said airfoils relative to one another so as to exert a minimum biasing force on the airfoils at positions of maximum and minimum opening thereof and to exert a maximum biasing force on said airfoils at intermediate positions.

18. An air volume regulator according to claim 14, wherein said means mounted in the path of air flow and having an opening therein for the flow of air therethrough comprises a cantilever mounted conduit, and wherein means carried by said conduit pivotally mount the opposing airfoils thereon for receiving the flow of air through the opening.

* * * * *